US005638730A

United States Patent [19]

Karlis

[11] Patent Number: 5,638,730

[45] Date of Patent: Jun. 17, 1997

[54] PLASTIC PAPER PUNCH WITH AXIALLY RECIPROCABLE PUNCH HEADS

[75] Inventor: Robert G. Karlis, Hingham, Mass.

[73] Assignee: Clix Products, Inc., Natick, Mass.

[21] Appl. No.: 593,875

[22] Filed: Jan. 30, 1996

Related U.S. Application Data

[63] Continuation-in-part of Ser. No. 176,544, Dec. 30, 1993, abandoned.

[51] Int. Cl.[6] ..... B26D 7/00

[52] U.S. Cl. ..... 83/167; 83/589; 83/599; 83/605; 83/618; 83/628; 83/633; 30/358; 402/1; 402/4

[58] Field of Search ..... 83/167, 599, 627, 83/628, 605, 633, 618, 620, 588, 589; 30/358; 402/1, 4

[56] References Cited

U.S. PATENT DOCUMENTS

| | | | |
|---|---|---|---|
| 1,142,032 | 6/1915 | Faifer . | |
| 1,567,643 | 12/1925 | Hearne . | |
| 2,137,716 | 4/1938 | Faas | 164/91 |
| 2,139,159 | 12/1938 | Hammen | 129/7 |
| 2,244,660 | 6/1941 | Carperter | 164/91 |
| 2,370,319 | 2/1945 | Lippincott | 164/124 |
| 2,474,344 | 1/1949 | Carpenter | 164/91 |
| 2,495,687 | 1/1950 | Belmont . | |
| 3,000,049 | 9/1961 | Terry, Jr. . | |
| 3,172,325 | 3/1965 | Wernham et al. | 83/599 |
| 3,303,564 | 2/1967 | Hendricks | 30/358 |
| 3,372,482 | 3/1968 | Mercorelli . | |
| 3,408,889 | 11/1968 | Murphy . | |
| 3,906,633 | 9/1975 | Inoue | 30/358 |
| 3,975,105 | 8/1976 | Cline | 402/1 |
| 4,594,927 | 6/1986 | Mori | 83/620 |
| 4,656,907 | 4/1987 | Hymmen | 83/571 |
| 4,869,143 | 9/1989 | Merrick et al. | 83/467.1 |
| 4,941,381 | 7/1990 | Garner | 83/468.94 |
| 5,247,863 | 9/1993 | Cohen | 83/167 |
| 5,291,813 | 3/1994 | Blumenthal et al. | 83/599 |
| 5,340,229 | 8/1994 | Schwartzman | 83/620 |
| 5,490,440 | 2/1996 | Karlis et al. | 83/599 |
| 5,501,128 | 3/1996 | D'Amore | 83/599 |

FOREIGN PATENT DOCUMENTS

| | | |
|---|---|---|
| 219896 | 8/1924 | United Kingdom . |
| 2209133 | 8/1987 | United Kingdom . |

*Primary Examiner*—Eugenia Jones
*Assistant Examiner*—Charles Goodman
*Attorney, Agent, or Firm*—Morse, Altman & Benson

[57] ABSTRACT

A paper punch comprising a one-piece die body, a one-piece press body, and a plurality of one-piece punch heads; the die body and press body being pivoted along a rocking axis for a rocking motion between an inactive position and an active position, the punch heads operating therebetween; the die body providing a base with die holes, guides with guide holes, and a paper reception region therebetween; the punch heads being constrained by the guide holes for reciprocation along the axes of the die holes and the guide holes; the press body controlling axial retraction of the punch heads from the paper reception region, and projection of the punch heads through the paper reception region and into the die holes, the inactive position being where the punch heads are substantially fully retracted from the paper reception region and the active position being where the punch heads are substantially fully projected into the paper reception region; the punch heads having slides at one extremity; guide channels in the press body for the slides by which reciprocation of the punch heads is controlled; the die body and press body having journals for establishing the rocking axis; and the rocking axis being located between the punch heads and the rearward edge of the press body and the rearward edge of the die body.

19 Claims, 5 Drawing Sheets

PLASTIC PAPER PUNCH WITH AXIALLY RECIPROCABLE PUNCH HEADS

BACKGROUND OF THE INVENTION

Related Applications

The present application is a continuation-in-part application of application Ser. No. 08/176,544, dated Dec. 30, 1993 for PLASTIC PAPER PUNCH WITH AXIALLY RECIPROCABLE PUNCH HEADS in the name of Robert G. Karlis, now abandoned.

FIELD OF THE INVENTION

The present invention relates to paper punches, i.e. punches for perforating sheets of paper for insertion into loose-leaf binders, and, more, particularly, to portable paper punches that are composed primarily of plastic.

THE PRIOR ART

Punches for perforating sheets of paper for insertion into loose-leaf binders and for retention therein have been known for many years and they come in a variety of shapes and sizes. The simplest punch comprises a pair of pivoted plates, one of which provides die holes and the other of which provides punch heads that integrally project therefrom. The punch heads and die holes are moveably arcuately about their pivot axis between a mating condition in which the punch heads are received by the die holes, and a release condition in which the punch heads are spaced from the die holes. The simplicity of its design makes this punch portable, but because of the arcuate movement between the die holes and the punch heads, ineffective tolerances are required. If the tolerances are too tight, excessive wear occurs at the points where the die holes and punch heads meet. If the tolerances are too loose, effective perforation of the paper sheets is inhibited or precluded. For the foregoing reasons, most simple punches of the foregoing type have been formed of metal.

More advanced paper punches use separate punch heads that reciprocate linearly within guide holes. This design solves the tolerance problem of the arcuately moving punch heads, but punches of this design are too bulky for general portability, such for carrying in a notebook or book bag. These punch also are generally manufactured out of metal, which makes them not only bulky but relatively heavy.

Thus there continues to be a need for a portable, light weight paper punch that has punch heads that move linearly rather than arcuately so that tolerances between the punch heads and die holes are not a problem.

SUMMARY OF THE INVENTION

An object of the present invention is to overcome the disadvantages of paper punches composed of plastic by avoiding arcuate movement of the punch heads with respect to the die holes.

A further object of the present invention is to overcome the portability disadvantages of the existing paper punches that are bulky and composed of metal.

The plastic paper punch of the present invention comprise a one-piece die body, a one-piece press body, and a plurality of one-piece punch heads. The die body provides a base with die holes, guides with guide holes, and a paper reception region therebetween. The punch heads are constrained by the guide holes to reciprocate along the axes of the die holes and the guide holes. The punch heads having slides at one extremity and the press body has channels into which the slides fit, by which the press body controls the axial retraction of the punch heads from the paper reception region and the projection of the punch heads through the paper reception region and into the die holes. The inactive position is when the punch heads are substantially fully retracted from the paper reception region and the active position is when the punch heads are substantially fully projected into the paper reception region.

The die body and press body pivot along a rocking axis for a rocking motion between an inactive position and an active position and the punch heads operate therebetween. The die body and press body have journals for establishing the rocking axis, which is located between the punch heads and the rearward edge of the press body and the rearward edge of the die body. Each journal has an inner bearing element presented by a rearwardly-directed protrusion on the die body and an outer bearing element presented by a forwardly-directed hook on the press body. Abutting against the rear surface of the hook is a latch established at the end of a spring arm that projects forwardly from near the rear edge of the die body.

Preferably, the under side of the die body provides a longitudinal groove which extends under all the die holes. A longitudinal slide slides into and out of the longitudinal groove is included which provides, in combination with the longitudinal groove, a receptacle for paper punch-outs.

Preferably, there are three pairs of aligned apertures between the journal and the rear edges of the die body and press body. The apertures are spaced apart so as to receive the rings of a loose-leaf binder.

BRIEF DESCRIPTION OF THE DRAWINGS

For a fuller understanding of the nature and object of the present invention, reference is made to the accompanying drawings, wherein.

DETAILED DESCRIPTION

Figure 1:
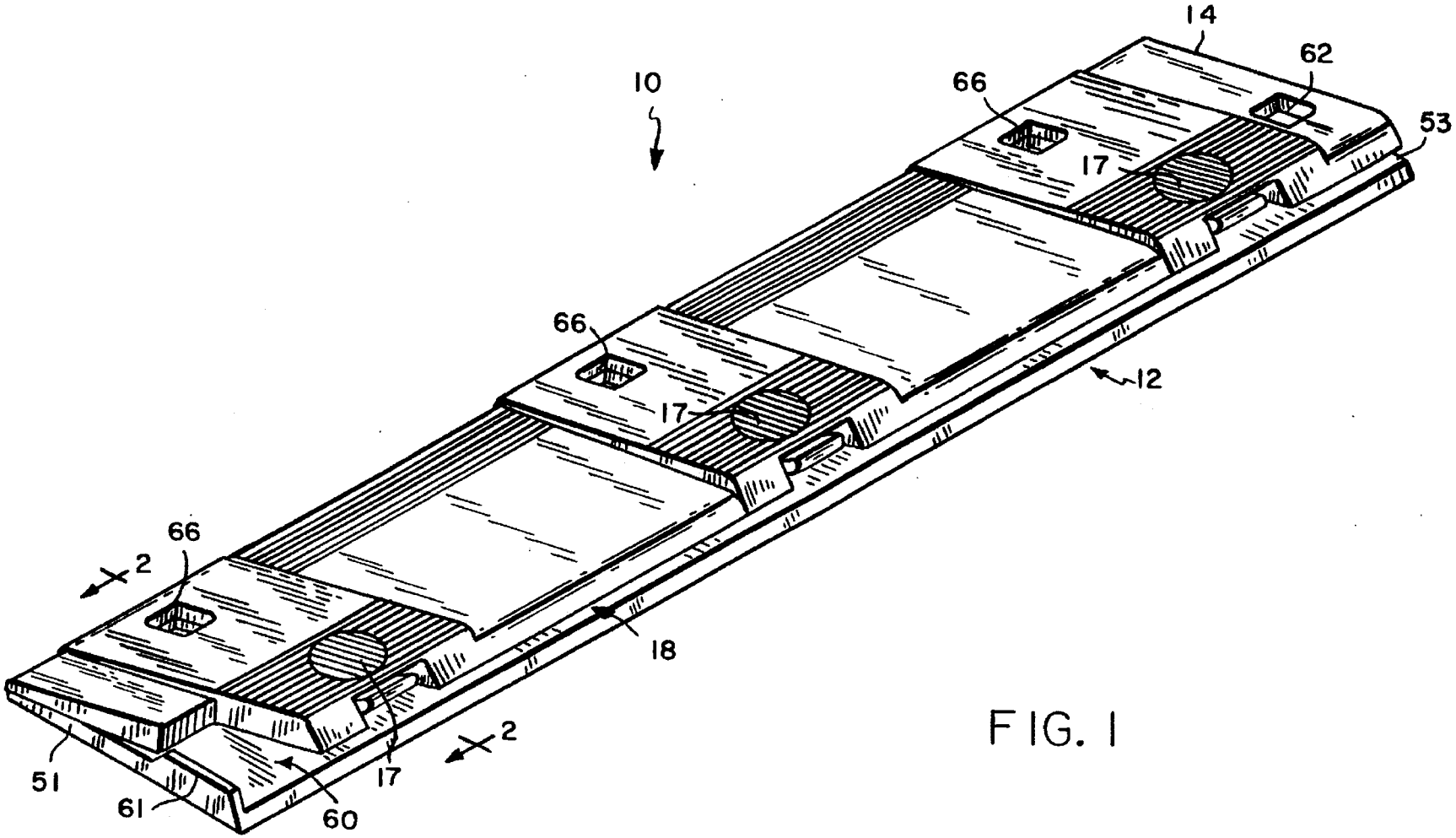
FIG. 1 is an isometric view of a paper punch constructed in accordance with the present invention.
Figure 2:
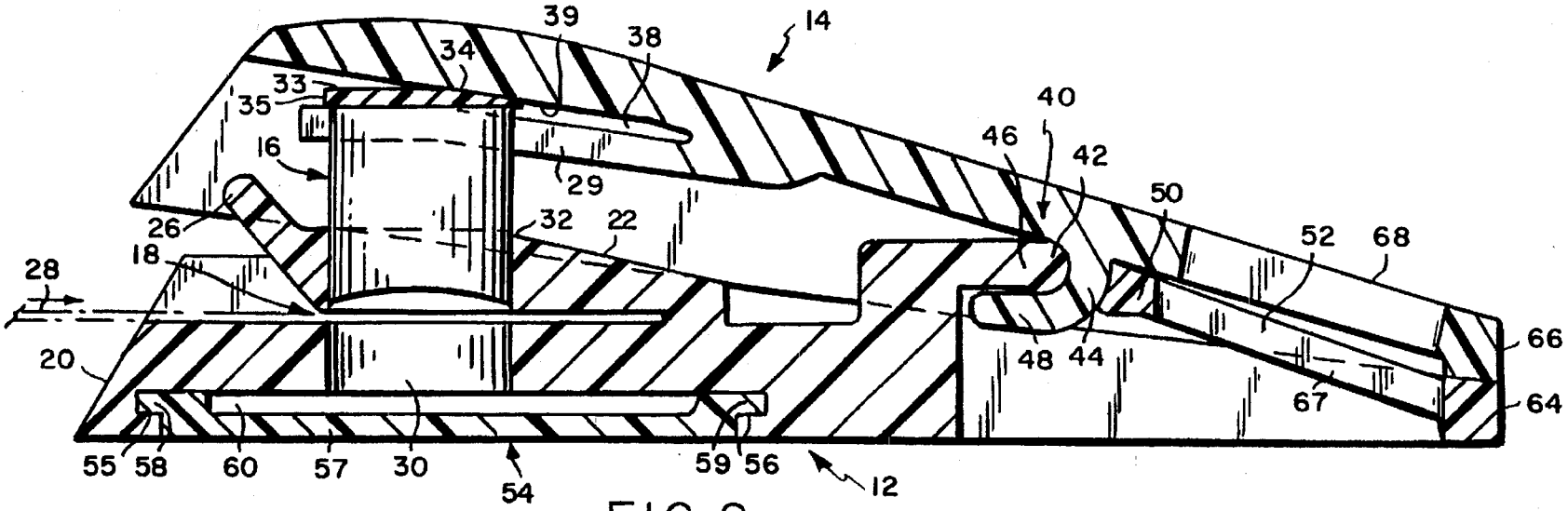
FIG. 2 is an enlarged cross-section of the paper punch of FIG. 1 taken along the line 2—2, illustrating one of its two operating states, namely, its inactive state.
Figure 3:
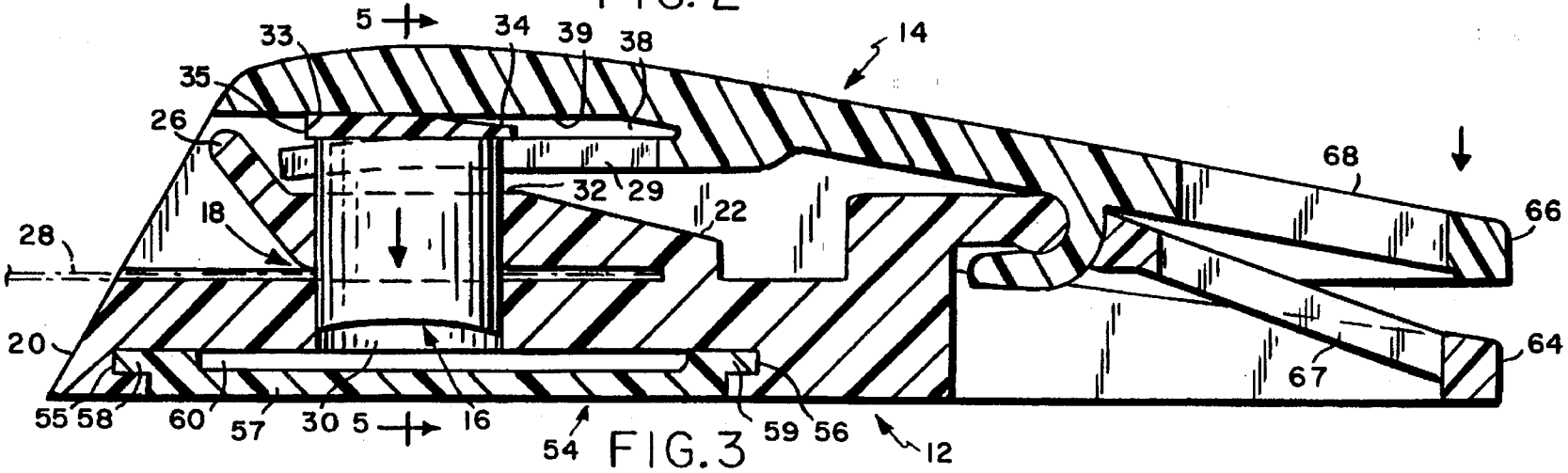
FIG. 3 is a view similar to FIG. 2, but illustrating the second of the two operating states, namely its active state.
Figure 4:
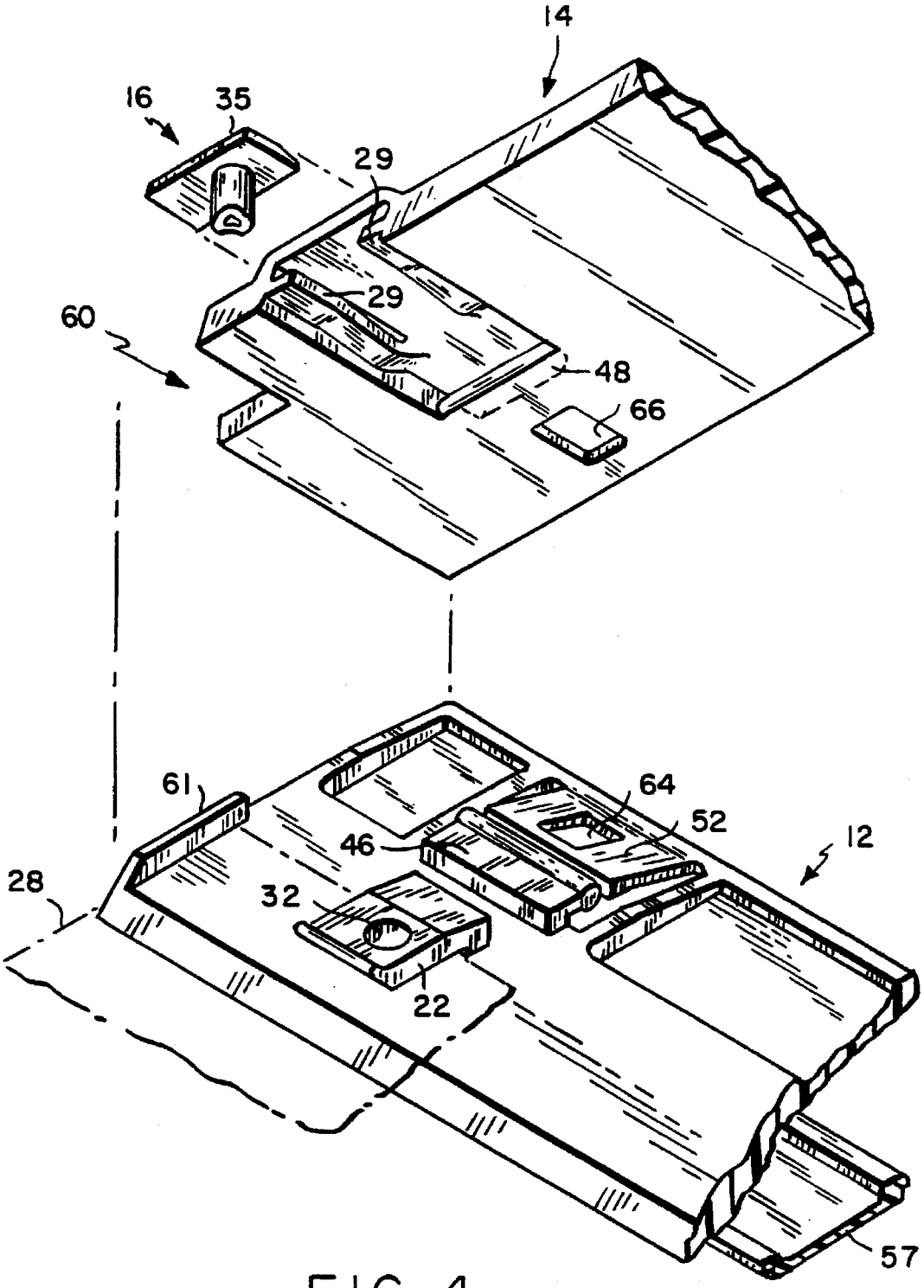
FIG. 4 is a fragmentary, exploded isometric view of the paper punch of FIG. 1, illustrating its three operative components, each composed of plastic.
Figure 5:
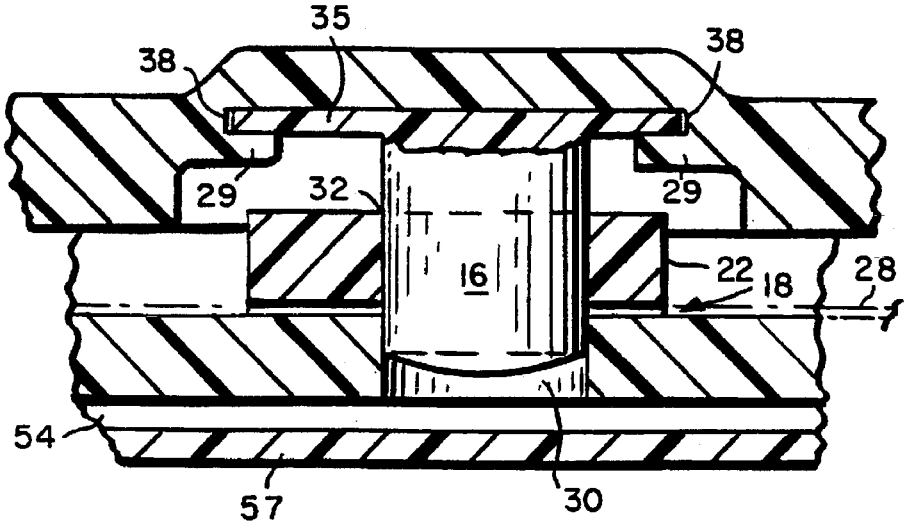
FIG. 5 is a fragmentary cross-section of the paper punch of FIG. 3 taken along the line 5—5.
Figure 6:
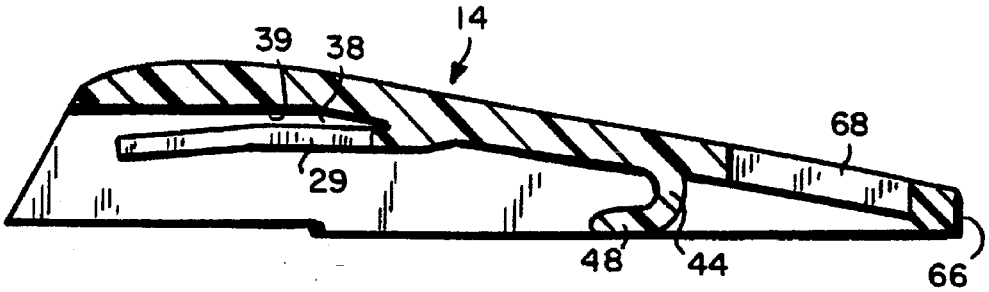
FIG. 6 is a cross-section of the disassembled press body taken along a transverse axis.

The illustrated embodiment of the present invention 10 is shown in FIGS. 1, 2 and 3 as comprising a lower die body 12, an upper press body 14, and a plurality of, in this case three, punch heads 16. The punch heads 16, which are shown in FIGS. 2–5 and 8–10, are hidden from view in the assembled punch of FIG. 1. However, their locations are indicated in the assembled punch by external circular markers 17 for reasons that are explained below. In the form shown, all of these components are composed of plastic, i.e. polymers. For example, the die body 12 is composed of a relatively high strength polymer such as polycarbonate, the press body 14 is composed of a high impact polymer such as polystyrene, and the punch heads 16 are composed of a relatively expensive polymer such as a polyacetal of the type sold by Celanese under the trade designation Celcon, which has been found to have an advantageous combination of strength and lubricity.

Preferably, the punch 10 is sized to fit conveniently into a loose-leaf binder. For the typical three-ring binder, the length of the punch 10 ranges from about 10 inches to about 12 inches. The height of the punch 10 is preferably between approximately ⅜ inch and ½ inch. The depth of the punch can vary significantly, but to provide the necessary leverage to punch holes and to retract the punch heads, the preferred depth is in the range of from approximately 1½ to 3 inches.

Figure 7:
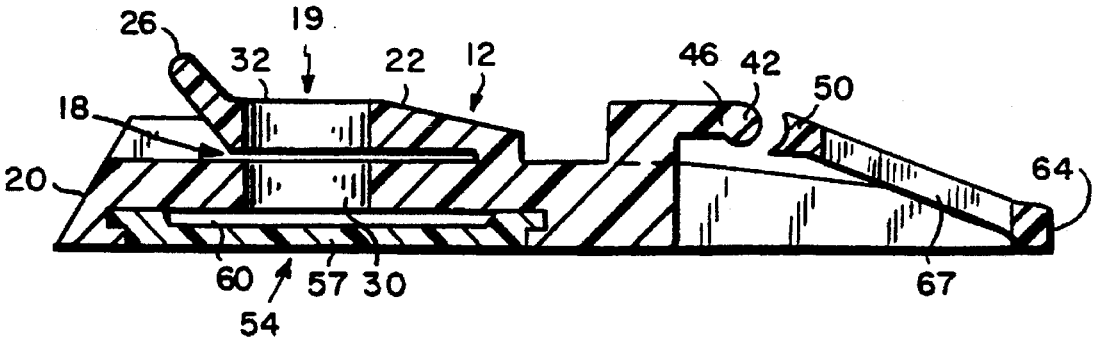
FIG. 7 is a cross-section of the disassembled die body taken along a transverse axis.

As shown in FIG. 7, the die body 12 includes an elongated base along which three punch stations 19 are distributed. Typically, the punch stations 19 are spaced to provide three holes that are linearly aligned and approximately 4¼ inches apart. This distance corresponds to the distance between the rings of a typical American three-ring loose-leaf binder. In another configuration, there are four punch stations, where the holes created are approximately 8 centimeters apart, corresponding to the distance between the rings of the typical four-ring A4-size loose-leaf binder. These two configurations are not intended as limitations on the number of punch stations. The present invention contemplates any number of punch stations with the spacing of the punch stations depending on the particular use of the punch.

The die body 12 provides, along its entire length, a paper reception slot 18, a lower die base 20, and an upper guide 22 that are formed as a single component. In the vicinity of each of the three punch stations 19, the upper guide 22 provides an upwardly and obliquely extending finger member 26, which is designed to facilitate entry of paper sheets, shown in phantom lines at 28, into the paper reception slot 18. The upper guide 22 also provides the critical function of stripping the paper sheet 28 from the punch heads 16 when the punch heads 16 retract into their inactive positions. At each of the three punch stations 19 is a die hole 30 that extends through the lower die base 20 and a guide hole 32 that extends through the guide 22. The die hole 30 and the guide hole 32 are axially aligned and of substantially the same diameter.

Figure 8:
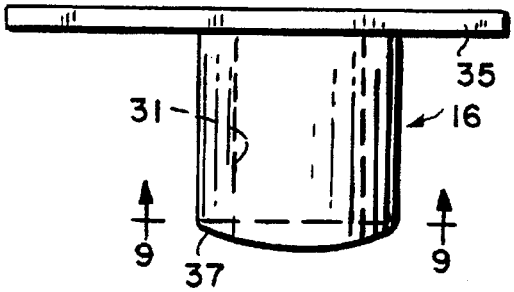
FIG. 8 is a front view of a punch head of FIG. 5.
Figure 9:
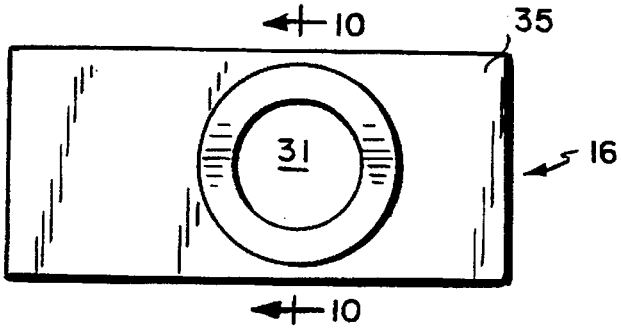
FIG. 9 is a bottom view of the punch head of FIG. 8 taken along the line 9—9.
Figure 10:
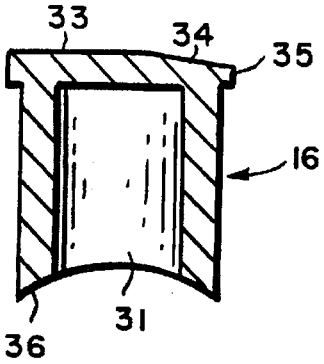
FIG. 10 is a cross-section of the punch head of FIG. 9 taken along the line 10—10.

The punch heads 16 are constrained by the guide holes 32 for reciprocation along the axes of the guide holes 32 and the die holes 30. The punch heads 16 are generally cylindrical in shape with a hollow center 31 and an outside diameter that ranges from approximately 3/16 inch to 5/16 inch. The lower end of each punch head 16 has an undulant configuration that provides its rim with sharp cutting edges. As shown in FIGS. 8 and 10, the lower cutting edge of each punch head 16 is convex as at 37 when viewed from the front and concave as at 36 when viewed from the side.

Integrally formed at the upper end of each punch head 16 is a slide 35. The slide 35, in transverse cross-section, provides an upper forward surface that serves as a rider 33 and an upper rearward surface that serves as a cam 34. The slide 35 is restricted to forward and rearward movement by a pair of channels 38 on opposite sides of the punch head 16 in which the slide 35 is located. The upper side of the channels 38 are defined by the under surface 39 of the press body 14 and the lower side of the channels 38 are defined by flanges 29 extending from the press body 14. The slides 35 are captured within the channels 38 between the under surface 39 and the flanges 29.

The rider 33 and the cam 34 are pushed downward by the under surface 39 of the press body 14 and pulled upward by the flanges 29. As a result of forward/rearward relative movement between the slide 35 and the press body 14, the punch head 16 is axially reciprocable between an inactive position in which its lower cutting edge is recessed in the guide hole 32, as shown in FIG. 2, and an active position in which its lower cutting edge is projected through the paper reception slot 18, and any paper sheets therein, into the die hole 30, as shown in FIG. 3. Note that the motion of the punch head 16 is linear rather than arcuate.

In the paper punches of the prior art, the punch heads are forced from the active position to the inactive position by springs, for example, coil strings that surround the punch heads or a leaf spring between the press body and die body. If the punch heads should become jammed, the operator must open the bottom of the punch and push the heads back to the inactive position with an object that fits into the die holes, such as a pencil. In the arrangement of the present invention, because the flanges 29 pull the punch heads 16 from the active position to the inactive position, the operator does not have to open the bottom and push the punch heads 16 up.

The die body 12 and the press body 14 rock with respect to each other about a journal 40, which has an axis that extends longitudinally along the punch 10 approximately midway between the punch heads 16 and the rear edges 64, 66 of the die body and press body. The journal 40 has an inner bearing element 42 and an outer bearing element 44. The inner bearing element 42, which is presented by a rearwardly-directed protrusion 46 on the die body 12, has a rearward, horizontal, convex cylindrical surface. The outer bearing element 44, which is presented by a forwardly-directed hook 48 on the press body 14, has a forward, horizontal, concave cylindrical surface. Abutting against the rear surface of the hook 48, which presents a horizontal, convex cylindrical surface, is a latch 50 that presents a horizontal, concave cylindrical surface. The latch 50 is established at the end of a spring arm 52 that projects forwardly from near the rear edge 64 of the die body 12.

To assemble the punch 10, the three punch head slides 35 are inserted into the channels 38, the punch heads 16 are aligned with the guide holes 32, and the hook 48 is snapped into engagement about the rearwardly-directed protrusion 46 simply by pressing the hook 48 against the spring arm 52 downwardly and forwardly. The pressure causes the spring arm 52 to bend downward until the rearwardly-directed protrusion 46 fits into the hook 48, after which the spring arm 52 returns to its original position, resulting in the latch abutting against the rear surface of the hook 48. The purpose of this design is to facilitate a simple and inexpensive assembly procedure. It is not designed for easy disassembly. The three independent spring arms 52 would have to be pried away from the press body 14 simultaneously and then the press body 14 pulled from the die body 12, needing at least two people to do so.

The under side of the die body 12 provides a longitudinal groove 54 which extends continuously along the die body 12 under all three die holes 30 from one end of the die body 53.

The longitudinal groove 54 includes furrows 55, 56 in the front and back walls that extend the entire length of the longitudinal groove 54. Sliding into and out of the longitudinal groove 54 from the end of the die body 12 is a longitudinal slide 57 which provides a receptacle for paper punch-outs 60. The longitudinal slide 56 includes flanges 58, 59 extending from the opposite sides that are adapted to fit snugly into the furrows 55, 56. Preferably, the longitudinal slide 57 is composed of a polymer such as polystyrene.

To facilitate portability and convenience, there are three pairs of aligned apertures 67, 68 in a line parallel to the journal 40 between the journal 40 and the rear edges 64, 66 of the die body and press body. The pairs of apertures 67, 68 are spaced apart so as to receive the rings of a loose-leaf binder for convenient retention therein.

The die body has a lip 61 that extends upwardly from one end 51. The lip 61 is used to position the sheet of paper so that all sheets of paper punched with the punch of the present invention 10 have their holes consistently located. To facilitate the use of the lip 61, the press body 14 has a cut-out region 60 and a window region 62 by which the position of a sheet of paper may be observed within the paper reception slot 18 prior to punching.

In the embodiment of FIGS. 1–10, the punch heads 16 are retracted when the die body rear edge 64 and the press body rear edge 66 are manually pinched together. In the alternate embodiment of FIG. 11, a helical spring 70 is placed between the die body 12 and the press body 14 to automatically retract the punch heads 16.

OPERATION

To operate, a sheet of paper 28 is first inserted into the paper reception slot 18 and aligned by eye using the lip 61, the cut-out region 60, and the window region 62. The die body 12 and the press body 14 cooperate to drive the punch heads 16 through the sheet of paper 28 and into the die holes 30 when the operator pinches the die body 12 and the press body 14 together at the front of the punch 10. When the operator presses the press body 14 in the vicinity of markers 17, effective operation of the punch stations 19 is ensured. The punch heads 16 reciprocate axially into and out of the die holes 30, thereby maximizing cutting efficacy and minimizing wear.

Figure 11:
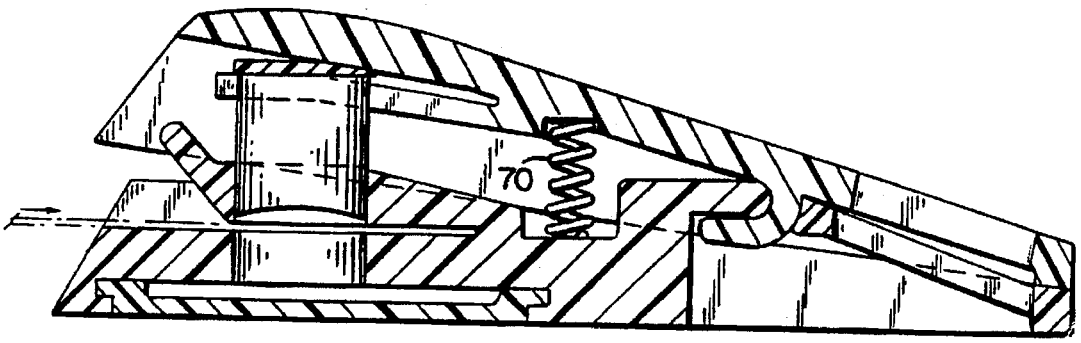
FIG. 11 is an enlarged cross-section of another embodiment of the present invention.

In the embodiment of FIGS. 1–10, the punch heads 16 are retracted from the die holes 30 and the sheet of paper 28 by pinching the die body 12 and press body 14 together near their rear edges 64, 66. In the embodiment of FIG. 11, the punch heads 16 are retracted automatically by the spring 70 when the operator discontinues pinching the die body 12 and press body 14 together. Then the punched sheet of paper 28 is removed from the paper reception slot 18. The punch-outs are stored in the punch-out receptacle 60 until it is emptied. The receptacle 60 is emptied by sliding the longitudinal slide 57 out of the longitudinal groove 54.

What is claimed is:

1. A paper punch comprising:

(a) a one-piece die body having a rearward edge, a one-piece press body having a rearward edge, and a plurality of one-piece punch heads, each of said punch heads having a slide at one extremity thereof;

(b) said die body and said press body being pivoted along a rocking axis for a rocking motion over a full range of motion between an inactive position and an active position, and said punch heads operating therebetween;

(c) said die body providing a base with die holes, guides with guide holes, and a paper reception region therebetween;

(d) said punch heads being constrained by said guide holes for reciprocation along axes of said die holes and said guide holes;

(e) said press body having guide channels for said slides for controlling axial retraction of said punch heads from said paper reception region, and projection of said punch heads through said paper reception region and into said die holes, said inactive position being where said punch heads are substantially fully retracted from said paper reception region and said active position being where said punch heads are substantially fully projected into said paper reception region;

(f) said die body and said press body having journals for establishing said rocking axis;

(g) said rocking axis being located between said punch heads and said rearward edge of said press body and between said punch heads and said rearward edge of said die body; and (h) each of said slides providing an upper forward rider surface and an upper rearward cam surface, said press body providing an under surface within each of said guide channels for cooperation with said rider surface and said cam surface, said cam surface being in contact with said under surface when said punch heads are in said inactive position but not in said active position, and said rider surface being in contact with said under surface when said punch heads are in said active position but not in said inactive position.

2. The paper punch of claim 1 wherein each of said guide channels includes an upper side and a lower side and wherein said press body provides an under surface that defines said upper side of said guide channels and flanges that define said lower side of said guide channels, said punch heads being projected into said active position by said press body under surface and being retracted into said inactive position by said flanges.

3. The paper punch of claim 1 wherein each of said journals presents an inner bearing surface on a rearward protrusion in said die body, an outer bearing surface on a forwardly directed hook in said press body, and a spring arm on a forwardly extending protrusion in said die body, said inner bearing surface being in contact with said outer bearing surface and said contact being maintained by a latch bearing surface presented by said spring arm throughout said full range of motion of said rocking axis.

4. The paper punch of claim 1, wherein said die body provides a receiving compartment in association with said die holes for reception of paper punch-outs therefrom.

5. The paper punch of claim 4 wherein said die body provides an under surface having a longitudinal groove underlying said die holes, said groove having a forward side wall and a rearward side wall opposed to said forward side wall, each of said side walls having a furrow, said furrows being parallel, and a cover having opposed longitudinal flanges that mate with said furrows, and wherein said longitudinal groove and said cover establish said receiving compartment for punch-outs when said cover flanges are slipped into said furrows from an end of said longitudinal groove.

6. The paper punch of claim 1 wherein said die body includes a plurality of spaced apertures therethrough located between said rearward edge of said die body and said rocking axis and wherein said press body includes an equal number of apertures therethrough located axially with said die body apertures.

7. The paper punch of claim 1, wherein spring means are provided between said press body and said die body to urge retraction of said punch heads.

8. The paper punch of claim 1 wherein said rocking axis is located approximately mid-way between said punch heads and said rearward edge of said press body and approximately mid-way between said punch heads and said rearward edge of said die body.

9. A paper punch comprising:

(a) a one-piece plastic die body having a rearward edge, a one-piece plastic press body having a rearward edge, and a plurality of one-piece plastic punch heads, each of said punch heads having a slide at one extremity thereof;

(b) said die body and said press body being pivoted along a rocking axis for a rocking motion over a full range of motion between an inactive position and an active position, and said punch heads operating therebetween;

(c) said rocking axis being located between said punch heads and said rearward edge of said press body and between said punch heads and said rearward edge of said die body;

(d) said die body providing a base with die holes, guides with guide holes, and a paper reception region therebetween;

(e) said punch heads being constrained by said guide holes for reciprocation along axes of said die holes and said guide holes;

(f) said press body having guide channels for said slides for controlling axial retraction of said punch heads from said paper reception region, and projection of said punch heads through said paper reception region and into said die holes, said inactive position being where said punch heads are substantially fully retracted from said paper reception region and said active position being where said punch heads are substantially fully projected into said paper reception region;

(g) each of said guide channels including an upper side and a lower side, said press body providing an under surface that defines said upper side of said guide channels and flanges that define said lower side of said guide channels, said punch heads being projected into said active position by said press body under surface and said punch being retracted into said inactive position by said flanges;

(h) each of said slides providing an upper forward rider surface and an upper rearward cam surface, said cam surface being in contact with said press body under surface when said punch heads are in said inactive position but not in said active position, and said rider surface being in contact with said under surface when said punch heads are in said active position but not in said inactive position;

(i) said die body and said press body having journals for establishing said rocking axis; and (j) each of said journals presenting an inner bearing surface on a rearward protrusion in said die body, an outer bearing surface on a forwardly directed hook in said press body, and a spring arm on a forwardly extending protrusion in said die body, said inner bearing surface being in contact with said outer bearing surface and said contact being maintained by a bearing surface presented by said spring arm throughout said full range of motion of said rocking axis.

10. The paper punch of claim 9, wherein said die body provides a receiving compartment in association with said die holes for reception of paper punch-outs therefrom.

11. The paper punch of claim 10 wherein said die body provides an under surface having a longitudinal groove underlying said die holes, said groove having a forward side wall and a rearward side wall opposed to said forward side wall, each of said side walls having a furrow, said furrows being parallel, and a cover having opposed longitudinal flanges that mate with said furrows, and wherein said longitudinal groove and said cover establish said receiving compartment for punch-outs when said cover flanges are slipped into said furrows from an end of said longitudinal groove.

12. The paper punch of claim 9 wherein said die body includes a plurality of spaced apertures therethrough located between said rearward edge of said die body and said rocking axis and wherein said press body includes an equal number of apertures therethrough located axially with said die body apertures.

13. The paper punch of claim 9, wherein spring means are provided between said press body and said die body to urge retraction of said punch heads.

14. The paper punch of claim 9 wherein said rocking axis is located approximately mid-way between said punch heads and said rearward edge of said press body and approximately mid-way between said punch heads and said rearward edge of said die body.

15. A paper punch comprising:

(a) a one-piece plastic die body having a rearward edge, a one-piece plastic press body having a rearward edge, and a plurality of one-piece plastic punch heads, each of said punch heads having a slide at one extremity thereof;

(b) said die body and said press body being pivoted along a rocking axis for a rocking motion over a full range of motion between an inactive position and an active position, and said punch heads operating therebetween;

(c) said rocking axis being located between said punch heads and said rearward edge of said press body and between said punch heads and said rearward edge of said die body whereby manually pinching together said press body and said die body at said press body rearward edge and said die body rearward edge causes retraction of said punch heads;

(d) said die body providing a base with die holes, guides with guide holes, and a paper reception region therebetween;

(e) said punch heads being constrained by said guide holes for reciprocation along axes of said die holes and said guide holes;

(f) said press body having guide channels for said slides for controlling axial retraction of said punch heads from said paper reception region, and projection of said punch heads through said paper reception region and into said die holes, said inactive position being where said punch heads are substantially fully retracted from said paper reception region and said active position being where said punch heads are substantially fully projected into said paper reception region;

(g) each of said guide channels including an upper side and a lower side, said press body providing an under surface that defines said upper side of said guide channels and flanges that define said lower side of said guide channels, said punch heads being projected into said active position by said press body under surface and said punch being retracted into said inactive position by said flanges;

(h) each of said slides providing an upper forward rider surface and an upper rearward cam surface, said cam surface being in contact with said press body under surface when said punch heads are in said inactive position but not in said active position, and said rider surface being in contact with said under surface when said punch heads are in said active position but not in said inactive position;

(i) said die body and said press body having journals for establishing said rocking axis;

(j) each of said journals presenting an inner bearing surface on a rearward protrusion in said die body, an outer bearing surface on a forwardly directed hook in said press body, and a spring arm on a forwardly extending protrusion in said die body, said inner bearing surface being in contact with said outer bearing surface and said contact being maintained by a latch bearing surface presented by said spring arm throughout said full range of motion of said rocking axis;

(k) said die body providing an under surface having a longitudinal groove underlying said die holes, said groove having a forward side wall and a rearward side wall opposed to said forward side wall, each of said side walls having a furrow, said furrows being parallel, and a cover having opposed longitudinal flanges that mate with said furrows, and wherein said longitudinal groove and said cover establish a receiving compartment for punch-outs when said cover flanges are slipped into said furrows from an end of said longitudinal groove; and (l) said die body including a plurality of spaced apertures therethrough located between said rearward edge of said die body and said rocking axis and said press body including an equal number of apertures therethrough located axially with said die body apertures.

16. The paper punch of claim 15, wherein spring means are provided between said press body and said die body to urge retraction of said punch heads.

17. The paper punch of claim 15 wherein said rocking axis is located approximately mid-way between said punch heads and said rearward edge of said press body and approximately mid-way between said punch heads and said rearward edge of said die body.

18. A paper punch comprising:

(a) a one-piece plastic die body having a rearward edge, a one-piece plastic press body having a rearward edge, and a plurality of one-piece plastic punch heads, each of said punch heads having a slide at one extremity thereof;

(b) said die body and said press body being pivoted along a rocking axis for a rocking motion over a full range of motion between an inactive position and an active position, and said punch heads operating therebetween;

(c) said rocking axis being located approximately midway between said punch heads and said rearward edge of said press body and approximately mid-way between said punch heads and said rearward edge of said die body;

(d) said die body providing a base with die holes having a diameter, guides with guide holes having a diameter, and a paper reception region therebetween, each of said guides providing a forwardly, upwardly, and obliquely extending finger member, said die hole diameter and said guide hole diameter being substantially equal;

(e) said punch heads being constrained by said guide holes for reciprocation along axes of said die holes and said guide holes;

(f) said press body having guide channels for said slides for controlling axial retraction of said punch heads from said paper reception region, and projection of said punch heads through said paper reception region and into said die holes, said inactive position being where said punch heads are substantially fully retracted from said paper reception region and said active position being where said punch heads are substantially fully projected into said paper reception region;

(g) each of said guide channels including an upper side and a lower side, said press body providing an under surface that defines said upper side of said guide channels and flanges that define said lower side of said guide channels, said punch heads being projected into said active position by said press body under surface and said punch being retracted into said inactive position by said flanges;

(h) each of said slides providing an upper forward rider surface and an upper rearward cam surface, said cam surface being in contact with said press body under surface when said punch heads are in said inactive position but not in said active position, and said rider surface being in contact with said under surface when said punch heads are in said active position but not in said inactive position;

(i) said die body and said press body having journals for establishing said rocking axis;

(j) each of said journals presenting an inner cylindrical bearing surface on a rearward protrusion in said die body, an outer cylindrical bearing surface on a forwardly directed hook in said press body, and a spring arm on a forwardly extending protrusion in said die body, said inner cylindrical bearing surface being in contact with said outer cylindrical bearing surface and said contact being maintained by a cylindrical bearing surface presented by said spring arm throughout said full range of motion of said rocking axis;

(k) said die body providing an under surface having a longitudinal groove underlying said die holes, said groove having a forward side wall and a rearward side wall opposed to said forward side wall, each of said side walls having a furrow, said furrows being parallel, and a cover having opposed longitudinal flanges that mate with said furrows, and wherein said longitudinal groove and said cover establish a receiving compartment for punch-outs when said cover flanges are slipped into said furrows from an end of said longitudinal groove; and (l) said die body including a plurality of spaced apertures therethrough located between said rearward edge of said die body and said rocking axis and said press body including an equal number of apertures therethrough located axially with said die body apertures.

19. The punch of claim 18 wherein there is at least one spring between said die body and said press body for urging axial retraction of said punch heads.

* * * * *